US005127422A

United States Patent [19]

Colón

[11] Patent Number: 5,127,422

[45] Date of Patent: Jul. 7, 1992

[54] ANTI-REFLUX SADDLE BOARD

[76] Inventor: Angel R. Colón, 9425 Holbrook La., Potomac, Md. 20854

[21] Appl. No.: 483,743

[22] Filed: Feb. 23, 1990

[51] Int. Cl.[5] ..... A61G 7/00

[52] U.S. Cl. ..... 128/845; 128/870; 128/871; 297/377

[58] Field of Search ..... 128/870–875, 128/845; 5/431; 297/452, 457, 375, 376, 377

[56] References Cited

U.S. PATENT DOCUMENTS

| | | | |
|---|---|---|---|
| 3,101,972 | 8/1963 | Laughlin | 297/377 |
| 3,293,669 | 12/1966 | Emery | 297/377 |
| 3,423,773 | 1/1969 | Yamate | 297/377 |
| 3,431,020 | 3/1969 | Tyndall | 297/377 X |
| 4,471,767 | 9/1984 | Guimond | 128/24 R |
| 4,566,449 | 1/1986 | Smith | 128/845 |

*Primary Examiner*—Robert A. Hafer
*Assistant Examiner*—Kevin G. Rooney

[57] ABSTRACT

The ARS is an adjustable therapeutic support platform for premature and fullterm infants for the positional treatment of gastroesophageal reflux. It is designed in two sizes for use in infant incubators and in hospital/-home cribs. It is made of washable plastic and can be positioned at both a 30 and a 45 degree angle. The supportive saddle and quick-release VELCRO straps secure the infant to the board while allowing fast and convenient access to the infant by all caretakers. This arrangement permits unrestrained movement of the infant's arms and legs. Features of the design achieve the objectives of optimum positional treatment of GER, maximum safety and comfort for the infant, maximum and unimpeded convenient access to the infant by caretakers, and maximum convenience for storage.

3 Claims, 6 Drawing Sheets

ANTI-REFLUX SADDLE BOARD

BACKGROUND OF THE INVENTION

1. Field of the Invention

This invention relates to an adjustable, portable, light, dual-sized, folding board for use in the positional treatment of gastroesophageal reflux and its complications in incubator-bound prematures and fullterm infants in standard cribs.

2. Background

Gastroesophageal reflux (GER) may be defined as the reverse flow of gastric contents into the esophagus. While reflux is quite common in infants, two out of every hundred infants will have prolonged problematic reflux, and one per two hundred will have medically significant reflux inviting failure to thrive, esophagitis, aspiration, and even apnea and bradycardia[1]. It is well known that children with developmental delay and/or significant neurological disease have an increased incidence of GER[2]. GER is therefore a potentially serious medical disorder requiring treatment. The current modalities employed for GER are smaller, more frequent and thickened feedings, pro-motility drugs (bethanechol, metoclopramide), and positional therapy[3].

Positional therapy has been shown to have good results in alleviating the symptoms and discomforts of GER. The infant must be placed in a prone position[4]—NOT supine—of from between 30 to 45 degree angles. The flexibility to adjust the angle is important, since there are variable degrees of GER. These are defined by the level where GER occurs in a patient's esophagus, the duration of the episode, and the gastric emptying time. Infants who have high level reflux events reaching the upper third of the esophagus require a higher degree of verticality, as do infants who have reflux events of long duration (greater than eight to ten seconds). Infants who have prolonged gastric emptying time require a longer interval of verticality, although not necessarily a higher degree of angle. These variables may differ at different times with the same infant. Positional therapy in which an infant is inclined towards a vertical angle must therefore be able to adapt to the individual needs of afflicted infants.

The positioning of the infant must be accomplished safely, eliminating the possibility of the infant choking, or rolling off the board. It must allow movement as unencumbered as possible since the infant will require long term positional therapy for this condition. In the event of a medical emergency, it must be possible to effect an easy and fast exit. At all other times the caretaker should have unrestricted and convenient access to the infant.

DISCUSSION OF THE PRIOR ART

Infant seat U.S. Pat. No. 4,359,045 permits adjustment of angles of inclination, but positions the infant in a supine position which is now known to worsen GER[4]. U.S. Pat. No. 281,833 incorporates this supine position in its concept, and does not provide torso support to the infant. Additionally, the use of cloth ties makes securing and removing the infant a time consuming task.

The design, U.S. Pat. No. 4,471,767, positions the infant in an appropriate and recommended prone position, but restricts the placement of the infant to 30 degrees. The device does not therefore have the necessary flexibility to adjust the angle of treatment for specific needs. Members of the medical community have noted that the device is heavy and cumbersome, and that the removal of the infant from the plastic seat is awkward and involved.[5] The device does not include circulation ports to prevent uneven temperatures in an incubator. The reflux pants of U.S. Pat. No. 4,745,926, and the harness design, U.S. Pat. No. 4,657,005 inhibit the care of the infant by not allowing convenient and unrestricted access for the caretaker. Device, U.S. Pat. No. 4,745,926, particularly requires a complicated endeavor to remove the infant from the article in ordinary as well as emergency situations. The use of safety pins to secure the device to a make-shift apparatus that has been properly inclined appears inadequate to the task and vulnerable to wear and tear. The cleaning or replacing of soiled garments is a more complicated practical and economic issue with both these devices. Neither device include plans for a positional structure, and therefore only partially address the objective of positional therapy for infants with GER. Device, U.S. Pat. No. 3,423,773, is large, heavy, and thick, designed for supporting an infant in gesso cast or other orthopedic device. It cannot possibly fit into an incubator, or be used safely in a crib.

Reflux can occur in any size infant, including growing prematures who now constitute a large percentage of nursery boarders, and who require incubator care, often for months. None of the prior art lend themselves to incubator use in the treatment of the premature infant. The current invention has two sets of dimensions. One device fits into incubators with space to accommodate ancillary equipment. The model for premature infant use has incubator venting ports. Both sizes of the device have ports for supporting monitoring wires for premature and fullterm infants who require cardio-pulmonary monitoring.

SUMMARY OF THE INVENTION

The Anti-Reflux Saddle Board (ARS) is an adjustable, lightweight, portable, folding medically therapeutic bed insert for the positional treatment of gastroesophageal reflux to alleviate the symptoms and distress related to this and its complications.

The invention is a one piece molded plastic construction with removable adjustable straps. It is inexpensive to produce, lightweight, washable, non-porous and unbreakable. The thinner gauged model for premature and incubator use in hospital nurseries can be considered a disposable model. The non-metal plastic construction allows for emergency x-rays to be taken without the need of removing the infant. The device comes in two sizes, for premature infants requiring incubator, and for use in fullterm infant cribs. The ARS is adjustable to both a 30 and a 45 degree angle to allow the optimum flexible positional treatment of gastroesophageal reflux. A saddle support for the infant's legs to straddle gives body support without encumbering the infant. The elevated sides of the board prevent the infant from rolling off.

The infant is comfortably and safely restrained by quick-release, adjustable straps that extend from under the armpits over the upper back and over the hips. There is no restraint to the movement of the child's arms and legs. Hospital staff and other caretakers (family) have immediate and unencumbered access to the infant at all times, eliminating any delay in an emergency while providing convenience in ordinary care situations. The ARS has two anchoring straps. The board has ports for supporting monitoring wires for those infants who require cardio-pulmonary monitoring. The model for premature infants has incubator venting ports to allow free circulation of air and moisture.

BRIEF DESCRIPTION OF THE DRAWINGS

There are six drawings.

Figure 1:
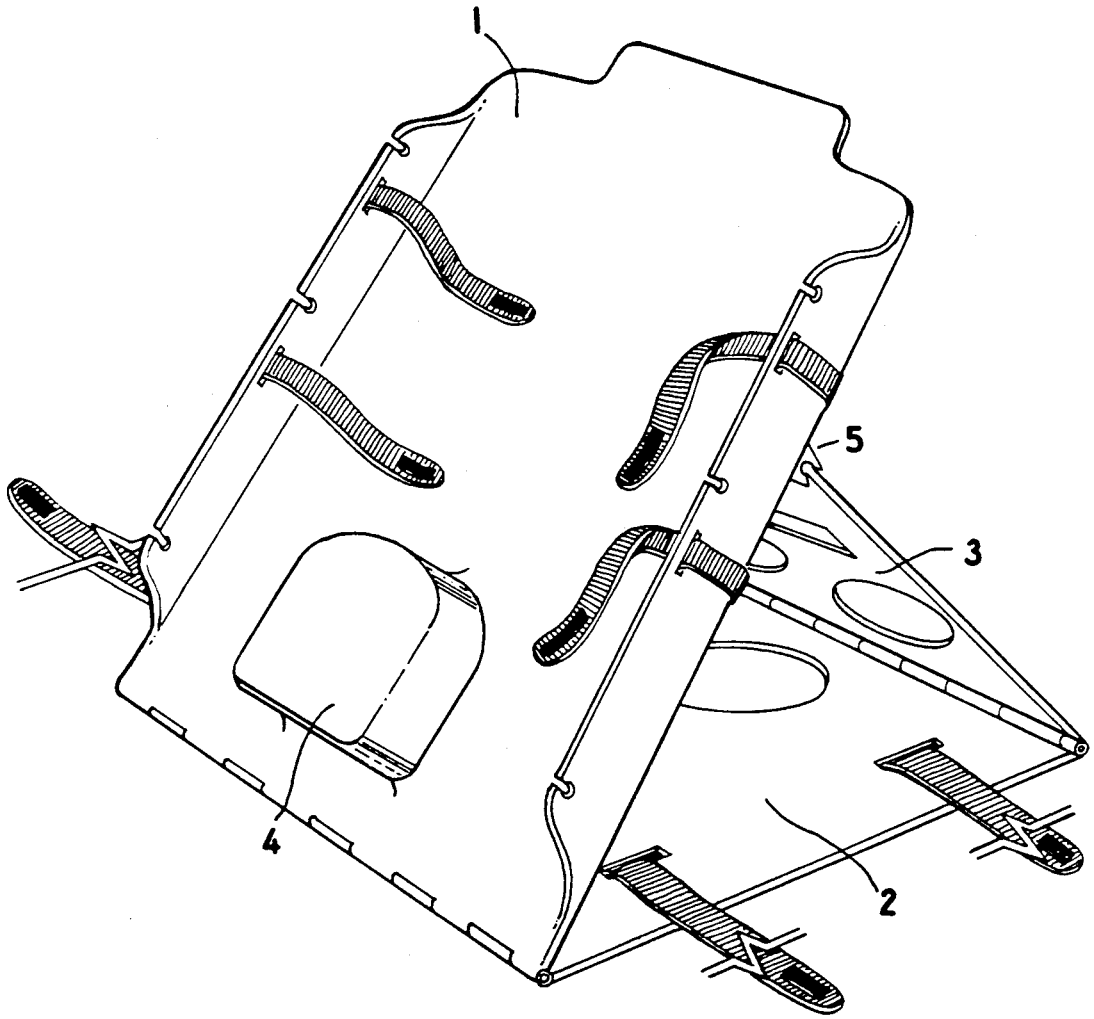
FIG. 1—Profile sketch of the device (ARS).
Figure 2:
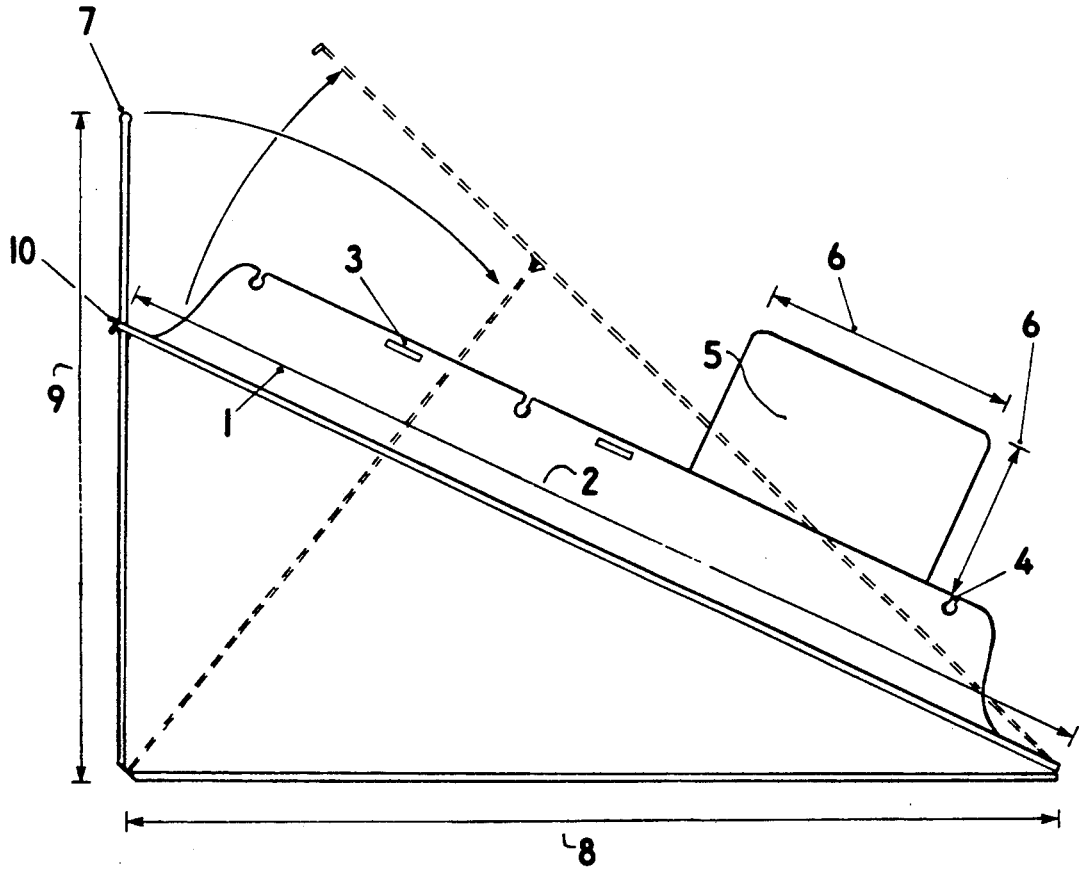
FIG. 2—Mechanical side drawing.
Figure 3:
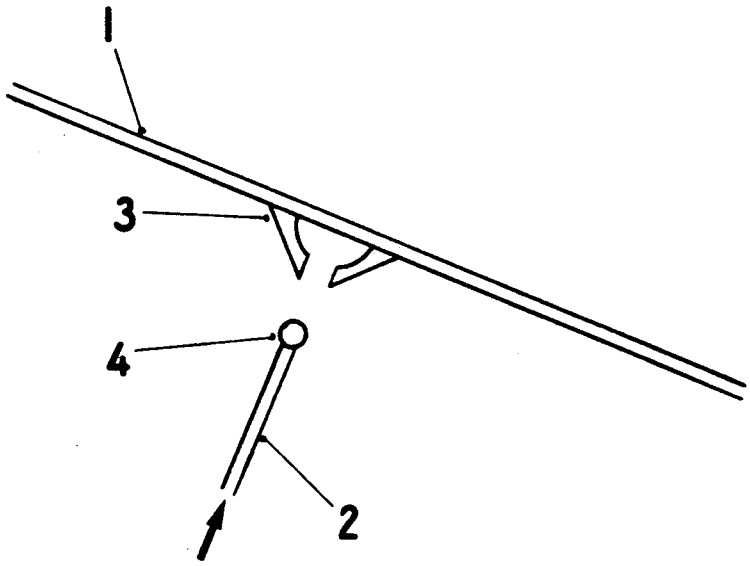
FIG. 3—Detail of the lock for 45 degree angle.
Figure 4:
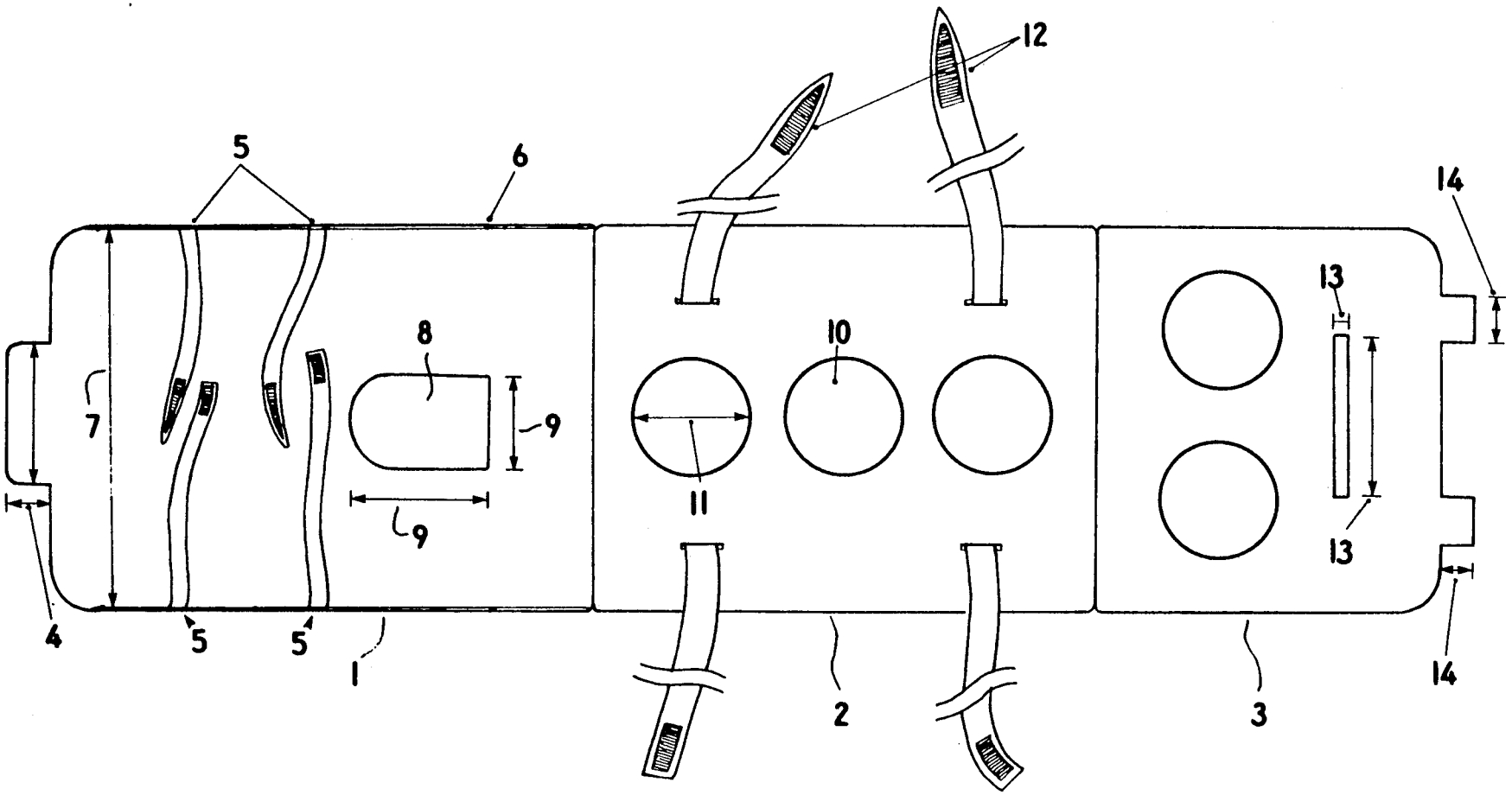
FIG. 4—Mechanical flat or open projection.
Figure 5:
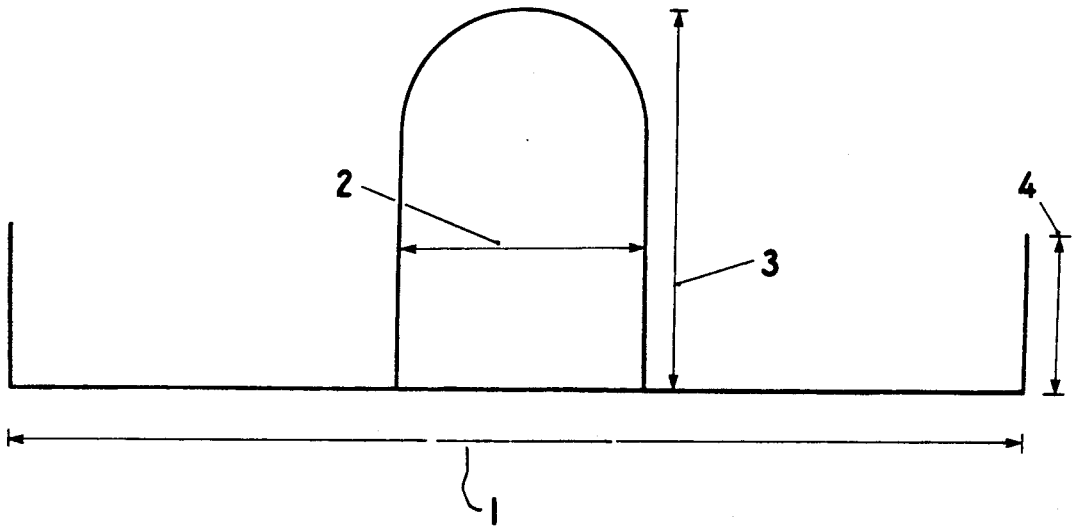
FIG. 5—Mechanical cross-section of board A (platform) showing "saddle".
Figure 6:
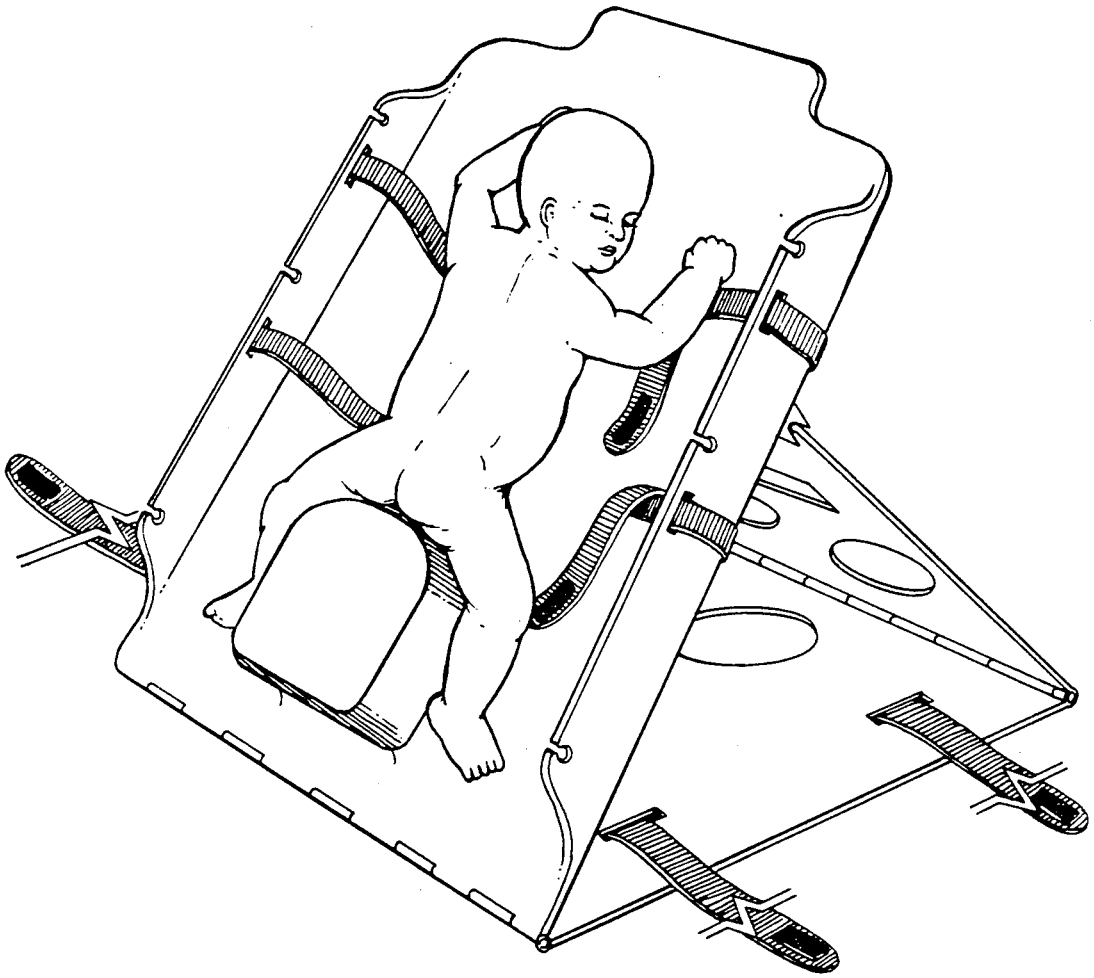
FIG. 6—Sketch of an infant on the board (bed).

There are six drawings of the present invention. The drawings refer to platform 1, floor 2, and support 3 of a single anti-reflux board all connected by plastic hinges. Dimensions of the invention are given for the size intended for premature infants in an incubator. Dimensions for the size intended for fullterm infants are given in parentheses. The premature infant model is made of 3 mm thick pliable white plastic, and, to meet hospital infectious disease regulations, can be disposable. The model for fullterm infant use is 6 mm thick.

Drawing ONE is an overall illustration of the anti-reflux saddle board positioned in the 45 degree angle. The infant rests on platform 1 which has elevated sides as a security feature, has lead ports for the use of monitoring wires, and slots into which are inserted security straps. Platform 1 shows the pair of washable, adjustable plastic straps that secure the infant from under the armpits, extending across the infant's back, and over the infant's hips. The saddle 4 depicts that part of the device straddled by the baby's legs on which the weight of the lower torso rests. On the back of the platform is shown a female lock which receives the male lock (support 3) to effect the 45 degree angle as shown. The locks are made of pliable plastic. Floor 2 illustrates the anchor straps which secure the device to the crib. Three venting ports to allow circulation of air and moisture in incubators are shown.

The drawing shows two of the four slots provided for the anchor straps. Support 3 has two additional venting ports, and the male lock that snaps into the female lock 5 on platform 1.

Drawing TWO shows a cross-section side view of the ARS in the 30 degree position, with a ghost outline of the device in a 45 degree position. Platform 1 is the surface on which the infant rests. It measures 35 cm (52 cm) long. The elevated sides of platform 1 are 4 cm (6 cm) high and 25 cm (35 cm) long. Shown are the slots for the straps that secure the baby to the board 3 . The slots are positioned 8 cm (11 cm) and 16 cm (21 cm) respectively from the top on the elevated sides of platform 1 to enable the baby to be securely and comfortably bound under the arms and over the hips. Three lead ports 4 for cardiac monitoring wires are located 4 cm, 14 cm, and 30 cm respectively down from the top edge of the elevated sides of platform 1. The saddle 5 is centered on platform 1 7 cm (10.5 cm) from the bottom. The saddle measures 6×9×9 cm (9×13.5×13.5 cm). At the top edge of platform 1 there is a projection measuring 9×3 cm (13.5×4.5 cm). It snaps into the slot provided on support 3 to position the platform at the 30 degree angle. On the reverse side of platform 1, 10 cm from the top edge of the board, is a female lock into which the male lock on support 3 is inserted to make the 45 degree angle position. Floor 2 rests on the surface area of the incubator or crib, and measures 32 cm (48 cm) long×25 cm (35 cm) wide (8). It has three venting ports and four slots (two on each side) through which the ARS anchoring straps are placed (not shown). Support 3 is shown perpendicular to floor 2. A slot 10 is positioned 7 cm from the top of the board to allow platform 1 to securely snap into a 30 degree angle. A male lock is placed at the tip of support 3 that inserts into a female lock on platform 1 to achieve a 45 degree angle. Support 3 has two venting ports (not shown).

Drawing THREE is a detail of the simple lock on 1 and 3 illustrating the mechanism provided to position the ARS at a 45 degree angle. On the reverse side of 1 there are two female locks 3 positioned 10 cm (13.5 cm) from the top of the platform. The male locks 4 are positioned at the tip of 2 and simply pop into the slots of platform 1's female locks. Since the plastic is pliable, this lock can be opened and closed with a simple snap.

Drawing FOUR is a flat projection of the ARS in an unfolded, open position to further illustrate the dimensions and configurations of the device.

Platform 1 shows that the top has a projection measuring 9×3 cm (13.5×4.5 cm) which, when fitted into the slot located on support 3, forms the 30 degree angle. The main body of platform 1 measures 25 cm wide by 35 cm long (35×52 cm). The safety straps 5 are positioned 8 (11) and 16 (21) cm from the top of the outside edge of 1. The lead ports 6 for cardiac monitoring wires are evenly positioned along the edges of the elevated sides of A. The saddle 8 straddled by the infant measures 6×9×9 cm (9×13.5×13.5 cm) (9) and is positioned in the center of the platform 7 cm (10.5 cm) from the bottom.

Floor 2 rests on the surface of the incubator or crib. The drawing illustrates three venting ports 10 to permit circulation of air and moisture when the infant is placed in an incubator. The diameter of each port is 7.5 cm (11). There are no venting ports provided in device intended for use by fullterm infants. The placement of the anchoring straps is illustrated at 12. The straps are of sufficient length to encompass either incubator or crib.

Support 3 is used to stabilize the ARS in both the 30 degree and the 45 degree angles. It has two venting ports for incubator use that measure 7.5 cm in diameter. They are positioned 5 cm from the hinged edge of 3. The slot that receives the projection from platform 1 to form the 30 degree angle is positioned 7.5 cm (10.5 cm) from the sides, and 15 cm (20 cm) from (13) the bottom edge of 3. The slot measures 10 cm×1 cm (14×1 cm). The drawing shows two male lock projections that snap into the female locks located on 1 to form a 45 degree angle. The male locks 14 measure 3×1.5 cm (4.5×2 cm) and are positioned 4.5 cm (6.0 cm) from each side of 3.

Drawing FIVE is a cross-section of platform 1 to illustrate the saddle 2 and its relationship to the side rails 4. The saddle measures 6×9×9 cm (9×13.5×13.5 cm) (3) and is positioned in the center of the platform 7 cm (10.5 cm) from the bottom.

Drawing SIX is a depiction of the ARS with a superimposed infant, at a 45 degree angle in the therapeutically preferred prone position. The drawing is for presentation and illustrative purposes only.

REFERENCES

1. Weissbluth, M. Gastroesophageal reflux. *Clinical Pediatrics* 20:7–13, 1981.

2. DiPalma, JS., Colon, AR, Gastroesophageal reflux. *American Family Physician* (In press, 1990).

3. Shepherd, RW., et al. Gastroesophageal reflux in children. *Clinical Pediatrics*. 26: 55–60, 1987.

4. Orenstein, Sr., et al. The infant seat as treatment for gastroesophageal reflux. *New England Journal of Medicine*. 309:760–763, 1983.

5. Personal communication and surveys.

I claim:

1. A method of treating gastroesophageal reflux (GER) in infants comprising the steps of:

(a) providing a therapeutic device comprising:

(i) an infant support piece having a flat bed surface which may be adjustably inclined between approximately 30° and approximately 45°, said flat bed surface having a saddle thereon to facilitate supporting the infant in a prone position;

(ii) a plurality of straps for holding the infant to the infant support piece;

(iii) a plurality of ports in said device for promoting air circulation to aid in thermoregulation;

(iv) wherein said device is constructed of radiolucent material to allow for in-situ radiography; and (b) placing the infant on the flat bed surface in a prone position to prevent the occurrence of GER.

2. The method of claim 1 wherein the device is sized to specifically fit within the confines of a standard incubator and wherein the method of treatment consists of placing the device in the incubator and placing a premature infant in a prone position on said flat bed surface.

3. The method of claim 1 wherein the device is of one-piece construction which may be folded into a generally flattened state and further comprises a floor piece hinge connected to both the infant support piece and a rear support piece, said rear support piece being connectable to said infant support piece to maintain said flat bed surface in an inclined position, said infant support piece having side extensions with slots for holding said straps.

* * * * *